US009844932B2

(12) United States Patent
Takakusa et al.

(10) Patent No.: US 9,844,932 B2
(45) Date of Patent: Dec. 19, 2017

(54) INKJET PRINTING MACHINE

(71) Applicant: RISO KAGAKU CORPORATION, Tokyo (JP)

(72) Inventors: Tadashi Takakusa, Ibaraki (JP); Mamoru Saito, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/416,330

(22) Filed: Jan. 26, 2017

(65) Prior Publication Data

US 2017/0217159 A1 Aug. 3, 2017

(30) Foreign Application Priority Data

Jan. 28, 2016 (JP) ..... 2016-014056
Jan. 25, 2017 (JP) ..... 2017-010866

(51) Int. Cl.

*B41J 29/393* (2006.01)
*B41J 2/045* (2006.01)
*B41J 25/00* (2006.01)
*B41J 2/21* (2006.01)

(52) U.S. Cl.

CPC ..... *B41J 2/04505* (2013.01); *B41J 2/04508* (2013.01); *B41J 2/2132* (2013.01); *B41J 25/001* (2013.01); *B41J 29/393* (2013.01)

(58) Field of Classification Search

CPC .... B41J 2/04508; B41J 2/2132; B41J 29/393; B41J 25/001

See application file for complete search history.

(56) References Cited

U.S. PATENT DOCUMENTS 8,419,156 B2 * 4/2013 Ito ..... B41J 29/10 347/101
9,114,608 B2 8/2015 Saitou
9,594,986 B2 3/2017 Ebisawa
2004/0090475 A1 * 5/2004 Ioka ..... B41J 2/04505 347/5
2005/0068358 A1 * 3/2005 Mizutani ..... B41J 2/2132 347/14

(Continued)

FOREIGN PATENT DOCUMENTS

JP 2005-262581 A 9/2005

OTHER PUBLICATIONS

U.S. Appl. No. 15/361,616 to Tadashi Takakusa, filed Nov. 28, 2016.
U.S. Appl. No. 15/466,030 to Mamoru Saito, filed Mar. 22, 2017.

*Primary Examiner* — Julian Huffman
(74) *Attorney, Agent, or Firm* — Greenblum & Bernstein, P.L.C.

(57) ABSTRACT

A controller determines the amount of driving by a sub-scanning driver and the number of nozzles to be used in accordance with a maximum amplitude of vibration of an inkjet head in a sub-scanning direction, where the maximum amplitude is detected by a displacement detecting sensor when the inkjet head is moved in the sub-scanning direction before starting printing. Then, while moving the inkjet head in a main-scanning direction, the controller performs printing by selecting nozzles to be used in accordance with displacement of the inkjet head in the sub-scanning direction detected by the displacement detecting sensor.

2 Claims, 10 Drawing Sheets

(56) References Cited

U.S. PATENT DOCUMENTS

| | | | | |
|---|---|---|---|---|
| 2006/0127156 | A1* | 6/2006 | Takahashi | B41J 19/04 400/303 |
| 2006/0147237 | A1* | 7/2006 | Hayashi | B41J 19/202 400/76 |
| 2007/0139466 | A1* | 6/2007 | Kim | B41J 29/393 347/39 |
| 2009/0161180 | A1* | 6/2009 | Nakayama | B41J 2/16579 358/502 |
| 2015/0151535 | A1* | 6/2015 | Kyoso | B41J 2/04525 347/12 |
| 2016/0229208 | A1* | 8/2016 | Neeb | B41J 29/26 |
| 2017/0013166 | A1* | 1/2017 | Katsuyama | H04N 1/4052 |

* cited by examiner

INKJET PRINTING MACHINE

CROSS REFERENCE TO RELATED APPLICATION

This application claims benefit of priority under 35 U.S.C. §119 to Japanese Patent Application No. 2016-014056, filed on Jan. 28, 2016 and Japanese Patent Application No. 2017-010866, filed on Jan. 25, 2017, the entire contents of which are incorporated by reference herein.

BACKGROUND OF THE INVENTION

1. Field of the Invention

The present invention relates to an inkjet printing machine that discharges ink from an inkjet head to perform printing.

2. Description of the Related Art

An inkjet printing machine that discharges an ink drop on a printing medium from a nozzle while moving an inkjet head including a plurality of nozzles, has been known in the art (See, for example, Japanese Patent Application Laid-Open No. 2005-262581). Such an inkjet printing machine is sometimes used to perform printing on a building material or on a surface of a decorative panel, which is so-called decoration.

Since such a building material or the like often has a heavy weight, the decoration employs a method in which the building material or the like, which is a target of the decoration, is arranged and fixed on a table and then printing is performed while an inkjet head unit is moved in a main-scanning direction. In this method, while an inkjet head is moved in the main-scanning direction, printing for pixels in a prescribed pitch width is performed. The inkjet head is then moved in a sub-scanning direction by the pitch width and printing for a next pitch width is performed.

However, in the inkjet printing machine that employs the above-described method of repeating a movement of the inkjet head unit in the main-scanning direction and a movement of the inkjet head unit in the sub-scanning direction, immediately after moved in the sub-scanning direction, the inkjet head unit vibrates in the moved direction. Residual vibration due to the movement may cause landing misalignment of ink drops, which brings degradation in printing quality. This conventionally requires stops of printing until the vibration immediately after the inkjet head unit is moved in the sub-scanning direction converges. As a result, there is a problem that the amount of printing per unit time is limited. To improve the productivity, recent inkjet printing machines tend to have the increased number of mounted inkjet heads along the increased number of nozzles of inkjet heads, and thus have the significantly increased weight of the inkjet head unit. With the increase in the weight of the inkjet head unit, convergence time of the vibration due to the movement of the inkjet head unit is delayed. If the printing is performed after the vibration converges, there is a problem that the productivity drops.

SUMMARY OF THE INVENTION

The present invention is made in view of the above discussion. One object of the present invention is to provide an inkjet printing machine employing a printing method of repeating moving an inkjet head unit in a main-scanning direction and moving the inkjet head unit in a sub scanning direction that can reduce influence of the residual vibration and improve the productivity by increasing the amount of printing per unit time while reducing the degradation of the printing quality.

According to one aspect of the present invention, there is provided an inkjet printing machine including: an inkjet head that includes a plurality of nozzles arranged along a sub-scanning direction; a main-scanning driver that moves the inkjet head in a main-scanning direction orthogonal to the sub-scanning direction; a sub-scanning driver that relatively moves the inkjet head and a printing medium in the sub-scanning direction; a displacement detector that detects displacement of the inkjet head in the sub-scanning direction; and a controller that performs a control for printing an image on the printing medium by alternately repeating an operation of discharging ink drops on the printing medium from the nozzles while causing the main scanning driver to move the inkjet head in the main-scanning direction, and an operation of causing the sub-scanning driver to relatively move the inkjet head and the printing medium in the sub-scanning direction, wherein the controller determines the amount of driving by the sub-scanning driver and the number of nozzles to be used among the nozzles in accordance with a maximum amplitude of vibration of the inkjet head in the sub-scanning direction, the maximum amplitude being detected by the displacement detector when the inkjet head is moved in the sub-scanning direction before starting printing, and performs printing by selecting at least one nozzle to be used in accordance with displacement of the inkjet head in the sub-scanning direction, the displacement being detected by the displacement detector while the inkjet head is moved in the main-scanning direction.

According to another aspect of the present invention, the controller changes the quantity of an ink drop discharged from a nozzle that is positioned at an end of the selected at least one nozzle to be used in accordance with displacement of the inkjet head in the sub-scanning direction detected by the displacement detector.

According to the above-described aspect of the present invention, the controller determines the amount of driving by the sub-scanning driver and the number of nozzles to be used among the nozzles in accordance with a maximum amplitude of vibration of the inkjet head in the sub-scanning direction, the maximum amplitude being detected by the displacement detector when the inkjet head is moved in the sub-scanning direction before starting printing. The controller further determines a printing pitch in the sub-scanning direction for one pass. The controller then performs printing by alternately repeating an operation of discharging an ink drop on the printing medium from the nozzles while causing the main scanning driver to move the inkjet head in the main-scanning direction, and an operation of causing the sub-scanning driver to relatively move the inkjet head and the printing medium in the sub-scanning direction by the printing pitch.

The controller performs printing by selecting at least one nozzle to be used in accordance with displacement of the inkjet head in the sub-scanning direction while the inkjet head is moved in the main-scanning direction. This enables a region of use nozzles, which is to be formed by selected nozzles for the printing pitch, to be moved following the displacement due to the vibration occurring when the inkjet head 41 relatively moves in the sub-scanning direction. As a result, the productivity is improved without causing degradation in the printing quality.

According to the above-described aspect of the present invention, the controller changes the quantity of an ink drop discharged from a nozzle that is positioned at an end of the selected at least one nozzle included in a region of use nozzles in accordance with displacement of the inkjet head in the sub-scanning direction due to vibration. It is therefore possible to deal with displacement smaller than the diameter of the nozzle, which cannot be absorbed only by selecting nozzles to be used, by changing the size of an ink drop at the end. As a result, degradation of the printing quality can be reduced further.

DESCRIPTION OF THE EMBODIMENTS

Figure 1:
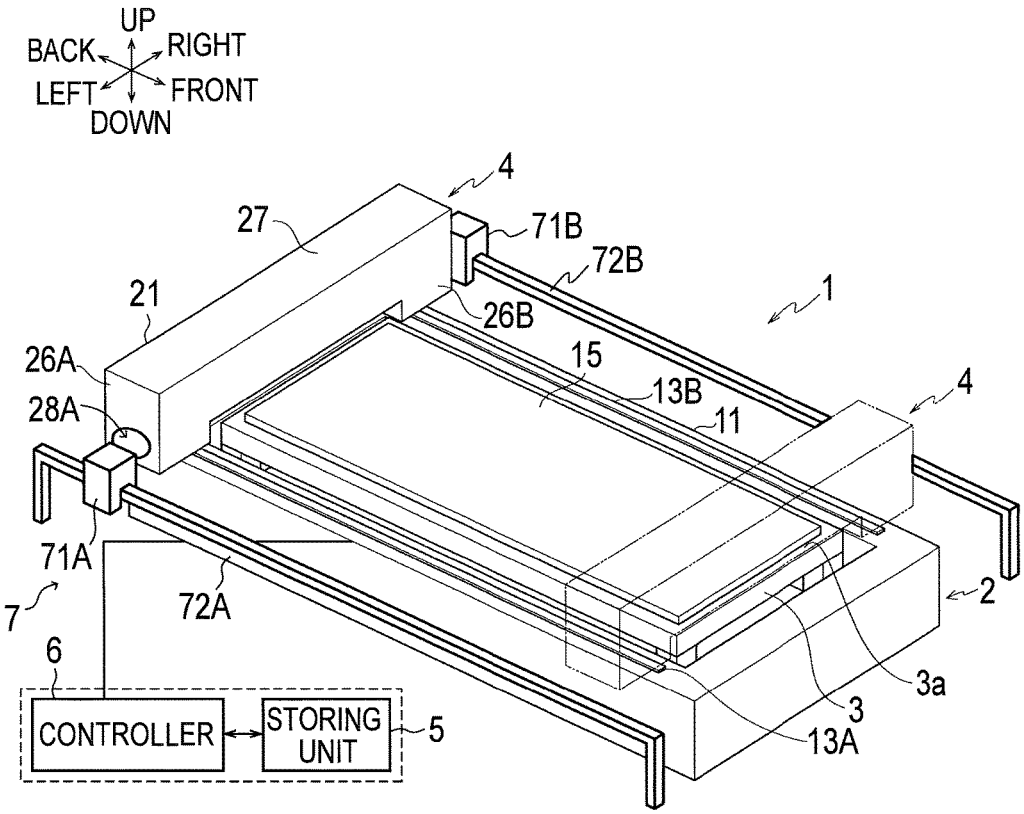
FIG. 1 is a schematic perspective view of a configuration of an inkjet printing machine according to a first embodiment of the present invention.

Exemplary embodiments of the present invention will be described below with reference to the accompanying drawings. In the drawings, the same or similar reference symbol is attached to the same or similar structural element.

The following embodiments present examples of an apparatus and the like for realizing the technical concept of the present invention. The technical concept of the present invention regarding the material, the shape, the structure, the arrangement, and the like of various structural components is not limited to these embodiments. Various modifications can be made in the technical concept of the present invention within the scope of claims.

First Embodiment

Figure 2:
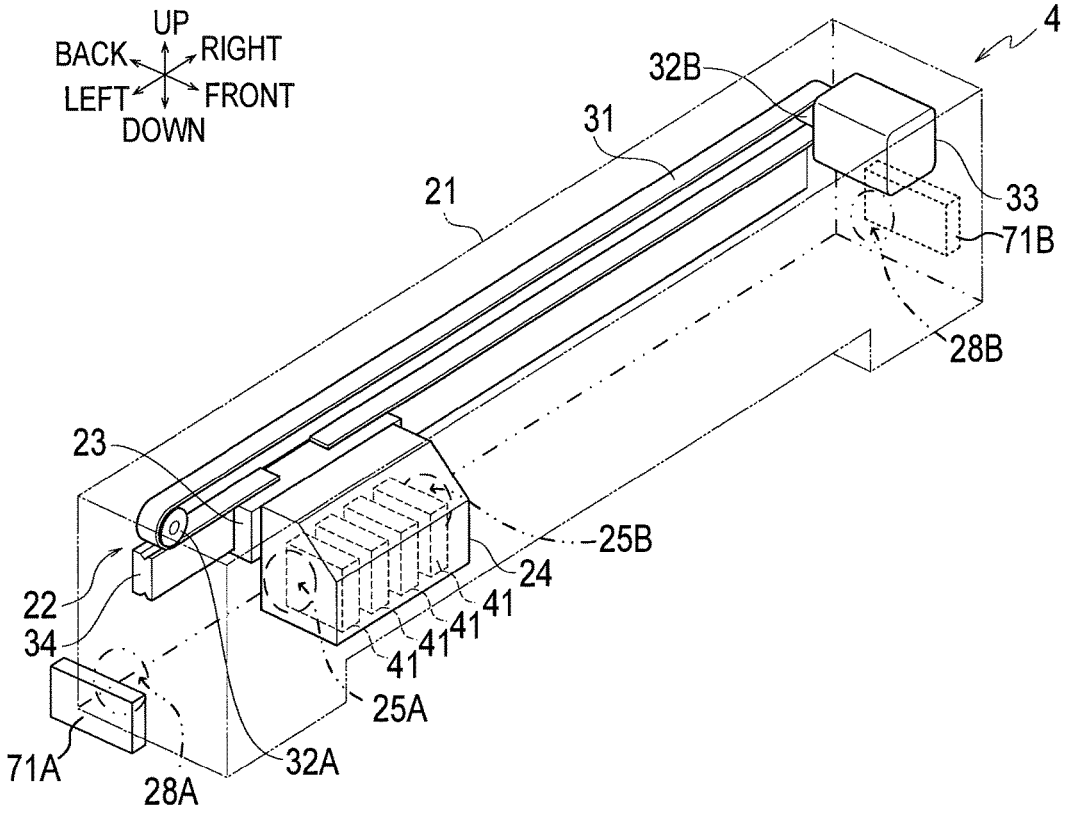
FIG. 2 is a perspective view of major parts of a shuttle unit of the inkjet printing machine shown in FIG. 1.
Figure 3:
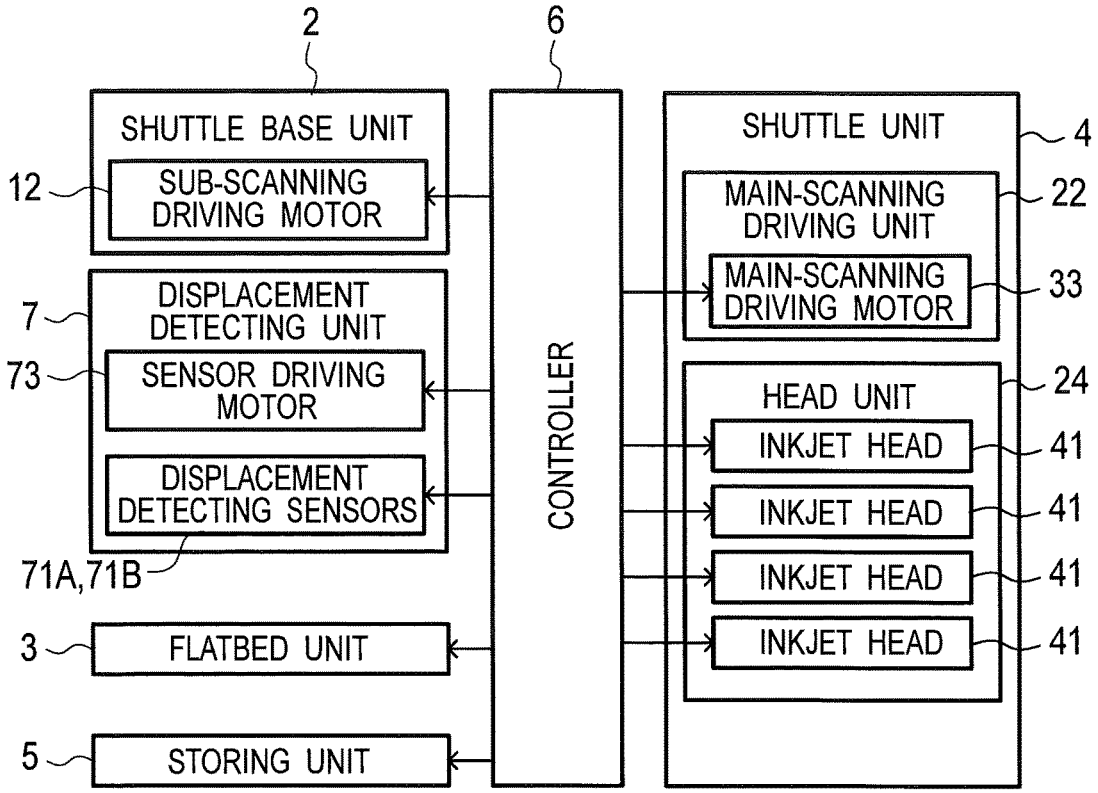
FIG. 3 is a control block diagram of the inkjet printing machine shown in FIG. 1.
Figure 4:
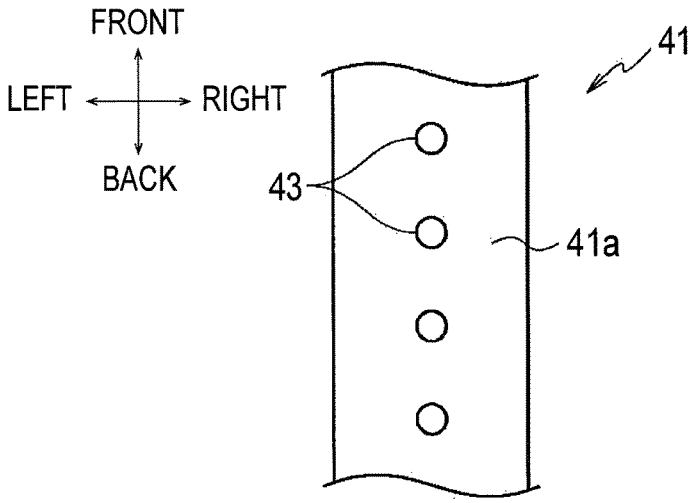
FIG. 4 is a schematic view of a nozzle face of an inkjet head shown in FIG. 2.

FIG. 1 is a schematic perspective view of a configuration of an inkjet printing machine according to a first embodiment of the present invention. FIG. 2 is a perspective view of major parts of a shuttle unit of the inkjet printing machine shown in FIG. 1. FIG. 3 is a control block diagram of the inkjet printing machine shown in FIG. 1. FIG. 4 is a schematic view of a nozzle face of an inkjet head of the inkjet printing machine shown in FIG. 1. In the following explanation, top and bottom, right and left, front and back shown with arrows in FIG. 1 define a vertical direction, a right-left direction, and a front-back direction, respectively.

(Configuration of Inkjet Printing Machine)

As shown in FIGS. 1 to 3, an inkjet printing machine 1 includes a shuttle base unit 2, a flatbed unit 3, a shuttle unit 4, a displacement detecting unit 7, a storing unit 5, and a controller 6.

The shuttle base unit 2 supports the shuttle unit 4 and moves the shuttle unit 4 in the front-back direction (sub-scanning direction). The shuttle base unit 2 includes a stand 11 and a sub-scanning driving motor 12.

The stand 11 supports the shuttle unit 4. The stand 11 has a shape of a rectangular frame. Sub-scanning drive guides 13A and 13B that extend in the front-back direction are arranged on a left and a right frames of the stand 11, respectively. The sub-scanning drive guides 13A and 13B guide the shuttle unit 4 that moves in the front-back direction.

The sub-scanning driving motor 12 is a sub-scanning driving unit for relatively moving inkjet heads 41 and a printing medium 15 in the sub-scanning direction. In particular, the sub-scanning driving motor 12 moves the shuttle unit 4 in the front-back direction.

The flatbed unit 3 supports the printing medium 15 constituted by a building material and the like. The flatbed unit 3 is arranged inside the stand 11 (a space surrounded by the frame thereof) of the shuttle base unit 2. The flatbed unit 3 has a medium placement surface 3*a* that is a horizontal surface for placing the printing medium 15. The height of the medium placement surface 3*a* of the flatbed unit 3 can be adjusted by using an elevator mechanism (not shown) constituted by a hydraulic driving mechanism and the like.

The shuttle unit 4 prints an image on the printing medium 15. As shown in FIGS. 1 to 3, the shuttle unit 4 includes a housing 21, a main-scanning driving unit 22, a main-scanning movable table 23, and a head unit 24.

The housing 21 houses all the parts such as the head unit 24. The housing 21 is formed in the form of a gate that arches over the flatbed unit 3 in the right-left direction. The housing 21 has a left leg member 26A and a right leg member 26B that are supported by the stand 11 of the shuttle base unit 2, and the housing 21 is movable along the sub-scanning drive guides 13A and 13B. The housing 21 includes a horizontal member 27 between the leg members 26A and 26B. A bottom side of the horizontal member 27 has an opening for discharging ink from the head unit 24 to the printing medium 15. The leg members 26A and 26B of the housing 21 include openings 28A and 28B formed on respective surfaces facing the displacement detecting unit 7. The openings 28A and 28B communicate with the inner space of the housing 21.

The main-scanning driving unit 22 moves the main-scanning movable table 23 in the right-left direction to move the head unit 24 in the right-left direction (main-scanning direction). The main-scanning driving unit 22 includes a driving belt 31, a pair of pulleys 32A and 32B, a main-scanning driving motor 33, and a main-scanning drive guide 34.

The driving belt 31 moves the main-scanning movable table 23 by making a circular movement. The driving belt 31 is stretched over the pulleys 32A and 32B.

The pulleys 32A and 32B support the driving belt 31 and cause the driving belt 31 to make the circular movement. The pulleys 32A and 32B are rotatably supported by a back-side wall of the housing 21. The pulleys 32A and 32B are separated in the right-left direction and are arranged at the same height. The pulley 32B is connected to an output shaft of the main-scanning driving motor 33 and transmits a rotary driving force of the main-scanning driving motor 33 to the driving belt 31.

The main-scanning driving motor 33 causes the driving belt 31 to make the circular movement by rotating the pulley 32B. The main-scanning drive guide 34 guides the main-scanning movable table 23 to move along the right-left direction. The main-scanning drive guide 34 is an elongated member and extends in the right-left direction. The main-scanning drive guide 34 is mounted on the back-side wall of the housing 21.

The main-scanning movable table 23 is a table on which the head unit 24 is placed. The main-scanning movable table 23 is fixed to the driving belt 31. The main-scanning movable table 23 moves along the main-scanning drive guide 34 in the right-left direction by the circular movement of the driving belt 31.

Figure 6:
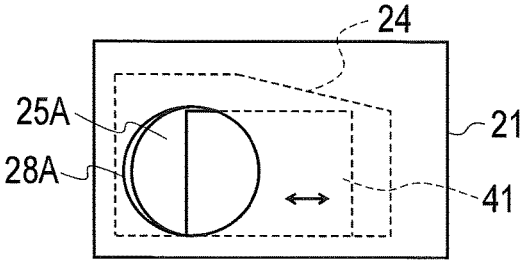
FIG. 6 is a diagram illustrating a positional relationship between the inkjet head of a head unit and openings.

The head unit 24 includes four inkjet heads 41. The head unit 24 discharges ink while moving in the right-left direction, thereby printing the image on the printing medium 15. The head unit 24 is mounted on the main-scanning movable table 23. The head unit 24 moves in the right-left direction along with the main-scanning movable table 23. The head unit 24 includes openings 25A and 25B formed on both sides thereof at respective positions facing the openings 28A and 28B. Since the housing 21 is formed with the openings 28A and 28B and the head unit 24 is formed with the openings 25A and 25B, an inkjet head 41 inside the housing 21 is visible from each side of the housing 21 as shown in FIG. 6.

The four inkjet heads 41 are arranged side-by-side in the right-left direction. As shown in FIG. 4, each of the inkjet heads 41 includes a plurality of nozzles 43 arranged along the sub-scanning direction. These nozzles 43 open on a nozzle surface 41*a*, which is a lower surface of the inkjet head 41. Ink drops are discharged on the printing medium 15 from the nozzles 43. Each of the four inkjet heads 41 discharges ink of a different color (for example, cyan, black, magenta, and yellow).

Figure 5A:
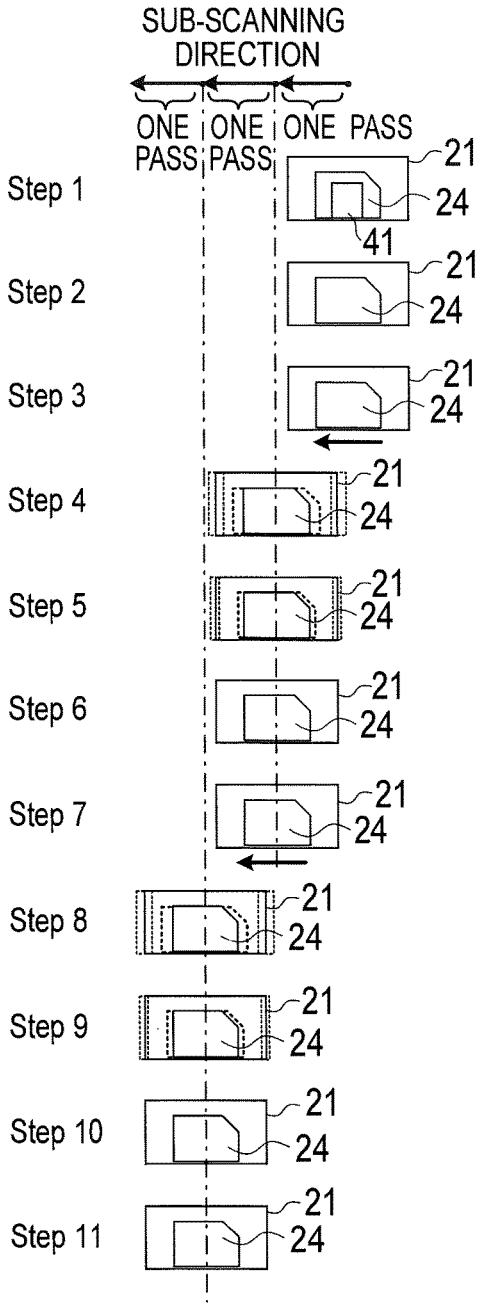
FIG. 5A is a diagram illustrating operations of inkjet heads inside the shuttle unit shown in FIG. 2 in respective steps, which are viewed from a side of a housing.
Figure 5B:
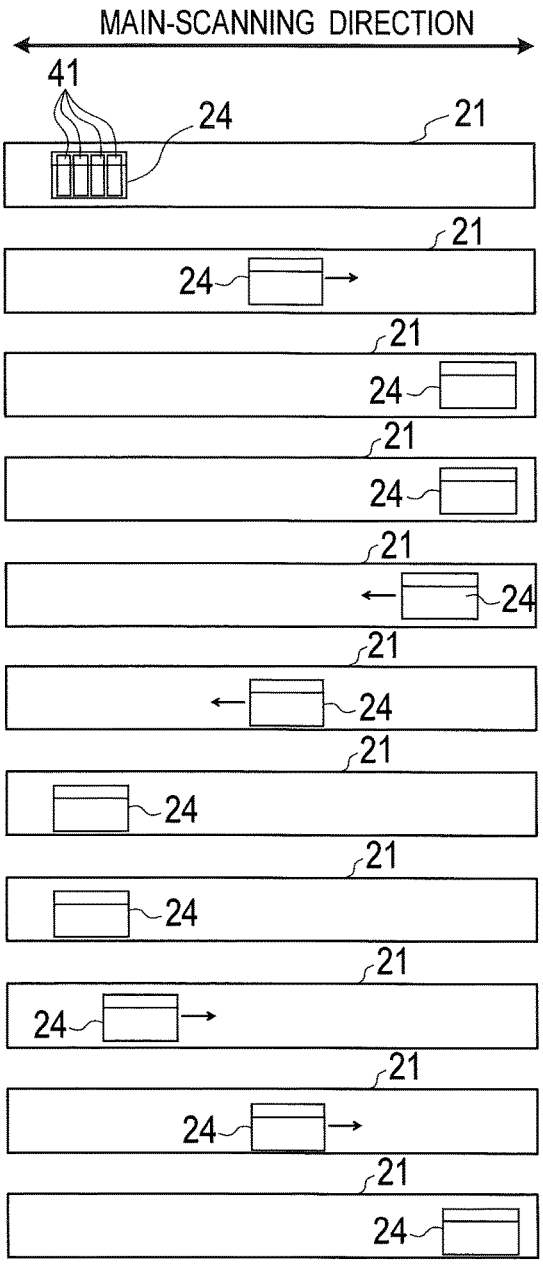
FIG. 5B is a diagram illustrating operations of the inkjet heads inside the shuttle unit shown in FIG. 2 in the respective steps, which are viewed from the front of the housing.

As shown in FIGS. 5A and 5B, the inkjet heads 41 print images on the printing medium 15 by alternatively repeating: an operation in which the inkjet heads 41 perform printing for one pass by discharging ink drops from the nozzles 43 on the printing medium 15 while being moved in the main-scanning direction by the main-scanning driving motor 33; and an operation in which the inkjet heads 41 are relatively moved in the sub-scanning direction by the sub-scanning driving motor 12.

FIG. 5A is a diagram illustrating operations of the inkjet heads 41 inside the shuttle unit 4 along the sub-scanning direction in respective steps, which are viewed from a side of the housing 21. FIG. 5B is a diagram illustrating operations of the inkjet heads 41 inside the shuttle unit 4 along the main-scanning direction in the respective steps, which are viewed from the front of the housing 21. FIGS. 5A and 5B illustrate operations of the inkjet heads 41 by dividing the operations into steps S1 to S11. It is noted that the inkjet heads 41 are omitted in steps S2 to S11 in FIGS. 5A and 5B because the inkjet heads 41 vibrate the same as the head unit 24.

Step S1 shows a state in which the inkjet heads 41 are positioned on the left side in the main-scanning direction. Step S2 shows a state in which the inkjet heads 41 are moving toward the right side in the main-scanning direction. Step S3 shows a state in which the inkjet heads 41 reach the right end in the main-scanning direction.

Step S4 shows a state in which the inkjet heads 41 move in the sub-scanning direction by one pass to reach a position for the next one pass. Step S5 shows a state in which the inkjet heads 41 start moving toward the left side in the main-scanning direction. Step S6 shows a state in which the inkjet heads 41 are moving toward the left side in the main-scanning direction. Step S7 shows a state in which the inkjet heads 41 reach the left end in the main-scanning direction.

Step S8 shows a state in which the inkjet heads 41 move in the sub-scanning direction by one pass to reach a position for the next one pass. Step S9 shows a state in which the inkjet heads 41 start moving toward the right side in the main-scanning direction. Step S10 shows a state in which the inkjet heads 41 are moving toward the right side in the main-scanning direction. Step S11 shows a state in which the inkjet heads 41 reach the right end in the main-scanning direction.

In this manner, the inkjet heads 41 inside the head unit 24 print images on the printing medium 15 by alternatively repeating: an operation in which the inkjet heads 41 perform printing for one pass by discharging ink drops from the nozzles on the printing medium 15 while being moved in the main-scanning direction by the main-scanning driving motor 33; and an operation in which the inkjet heads 41 are relatively moved in the sub-scanning direction by the sub-scanning driving motor 12.

When the weight of the head unit 24 is heavy due to an increase in the number of mounted inkjet heads, the head unit 24 vibrates in the sub-scanning direction immediately after the inkjet heads 41 move in the sub-scanning direction by one pass to reach the position for the next one pass as in steps S4 and S8. Further, as in steps S5 and S9, even after a predetermined time passes, the inkjet heads 41 have residual vibration in the sub-scanning direction due to the movement in the sub-scanning direction.

Back to FIGS. 1 to 4, the displacement detecting unit 7 is a displacement detector for detecting displacement of the inkjet heads 41 in the sub-scanning direction, and arranged on the right and left of the shuttle base unit 2. The displacement detecting unit 7 includes sub-scanning drive guides 72A and 72B extending in the front-back direction, displacement detecting sensors 71A and 71B movable along the sub-scanning drive guides 72A and 72B, and a sensor driving motor 73 for moving the displacement detecting sensors 71A and 71B. The sub-scanning drive guides 72A and 72B are provided independently from the shuttle base unit 2 so as not to receive the vibration of the shuttle base unit 2. The sub-scanning drive guides 72A and 72B have the same length as that of the shuttle base unit 2 in the front-back direction.

The sensor driving motor 73 is synchronized with the sub-scanning driving motor 12 to move the displacement detecting sensors 71A and 71B in the front-back direction in accordance with operations of moving the shuttle unit 4 in the front-back direction by the sub-scanning driving motor 12.

The displacement detecting sensors 71A and 71B are constituted by a displacement sensor, which is a transmission-type laser, for detecting displacement of the inkjet heads 41 in the sub-scanning direction. According to the present embodiment, the displacement detecting sensor 71A is a light-emitting device to emit laser light and the displacement detecting sensor 71B is a light receiving device to receive the laser light emitted from the displacement detecting sensor 71A.

The displacement detecting sensor 71A is arranged at a position facing the opening 28A of the housing 21 and the opening 25A of the head unit 24. The displacement detecting sensor 71B is arranged at a position facing the opening 28B of the housing 21 and the opening 25B of the head unit 24. In this manner, the displacement detecting sensors 71A and 71B are arranged to be opposite each other across the head unit 24.

This configuration enables the displacement detecting sensor 71B to receive laser light emitted from the displacement detecting sensor 71A through the openings 28A and 28B of the housing 21 and the openings 25A and 25B of the head unit 24. It is noted that the openings 28A and 28B and the openings 25A and 25B have a size large enough to let the laser light emitted from the displacement detecting sensor 71A pass therethrough such that the housing 21 and the head unit 24 does not interfere with the laser light even if the housing 21, the head unit 24 and the inkjet heads 41 vibrate integrally.

Figure 7A:
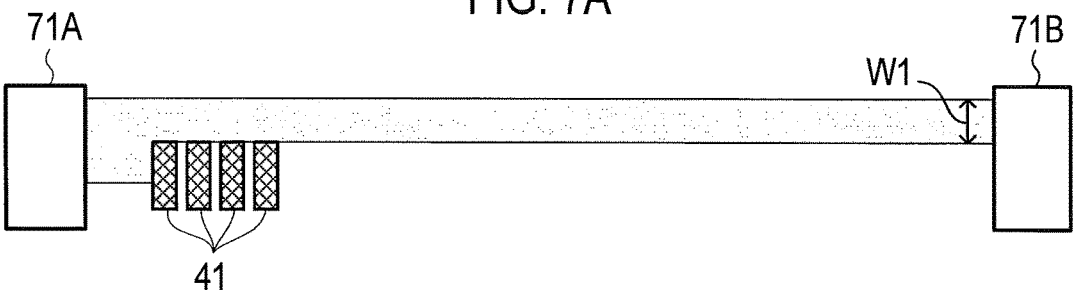
FIG. 7A is a diagram illustrating a state in which displacement detecting sensors shown in FIG. 1 detect displacement of the inkjet head.
Figure 7B:
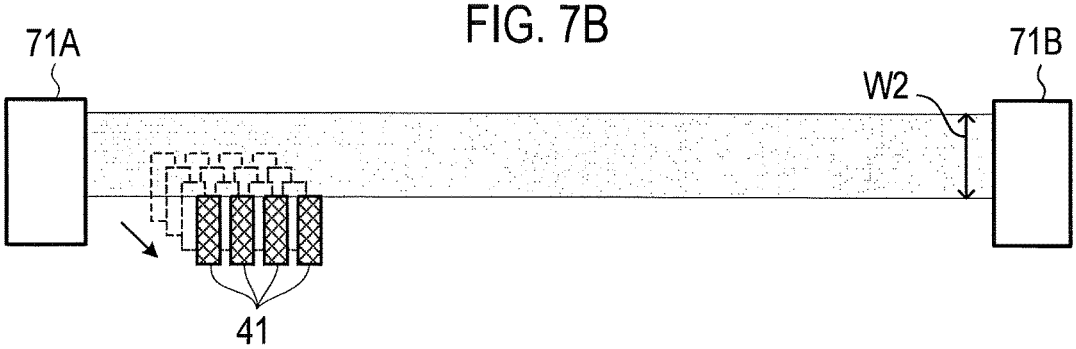
FIG. 7B is a diagram illustrating a state in which the displacement detecting sensors shown in FIG. 1 detect displacement of the inkjet head.
Figure 7C:
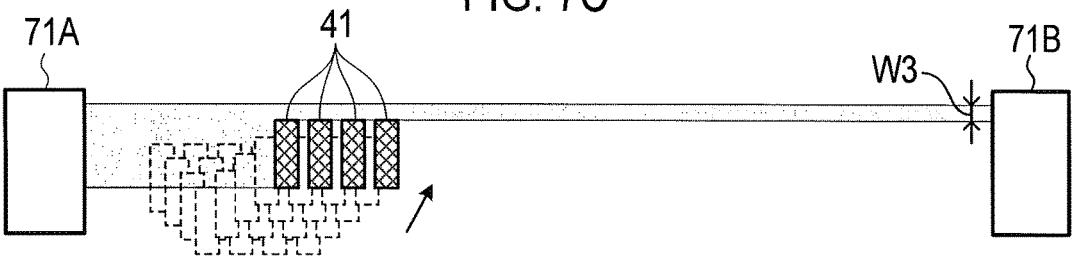
FIG. 7C is a diagram illustrating a state in which the displacement detecting sensors shown in FIG. 1 detect displacement of the inkjet head.

The displacement detecting sensors 71A and 71B detect positions of the inkjet heads 41 arranged inside the housing 21. FIGS. 7A to 7C show each state of the displacement detecting sensor 71 for detecting positions of the inkjet heads 41, which is viewed from the top of the inkjet printing machine 1. FIGS. 7A to 7C show a current position of the inkjet heads 41 by a solid line and positions of the inkjet heads 41 moving in the main-scanning direction and vibrating in the sub-scanning direction from a printing start position to the solid line by broken lines. It is noted that the housing 21 and the head unit 24 are omitted in FIGS. 7A to 7C.

FIG. 7A shows a state in which the head unit 24 does not vibrate at a position for each one pass in the sub-scanning direction, as in steps S1 to S3, S6 and S7, or S10 and S11 of FIGS. 5A and 5B. In this state, the amount of received light W1 received by the displacement detecting sensor 71B is stored as a reference amount in the storing unit 5.

On the other hand, FIGS. 7B and 7C show a state in which the vibration due to the movement in the sub-scanning direction occurs at a position for each one pass in the sub-scanning direction and the inkjet head 41 vibrates in the sub-scanning direction (front-back direction), as in steps S4 and S5, or S8 and S9 of FIGS. 5A and 5B. In these cases, a difference between the amount of received light W2 or the amount of received light W3 received by the displacement detecting sensor 71B and the amount of received light W1, which is the reference amount, is used to measure the displacement of the inkjet heads 41.

The storing unit 5 stores data related to various image processing. The data includes positional information for the inkjet heads 41 that corresponds to the amount of received light to be detected by the displacement detecting sensors 71A and 71B. The positional information for the inkjet heads 41 corresponding to the amount of received light is measured in advance. The storing unit 5 is constituted by an HDD (Hard Disk Drive) and the like.

The controller 6 is a processing unit for controlling operations of respective parts of the inkjet printing machine 1. The inkjet printing machine 1 has the controller 6 built-in, or the controller 6 can be realized with a dedicated control device such as an externally connected personal computer or a programmable logic controller (PLC). In particular, the controller 6 is constituted by a CPU, an RAM, a ROM and the like, and further includes a communication function as necessary.

The controller 6 controls the main-scanning driving motor 33, the sub-scanning driving motor 12 and the inkjet heads 41 to print images on the printing medium 15 by alternatively repeating: an operation in which the inkjet heads 41 perform printing for one pass by discharging ink drops from the nozzles on the printing medium 15 while being moved in the main-scanning direction by the main-scanning driving motor 33; and an operation in which the inkjet heads 41 and the printing medium 15 are relatively moved in the sub-scanning direction by the sub-scanning driving motor 12.

When the controller 6 controls the sub-scanning driving motor 12 to relatively move the inkjet heads 41 in the sub-scanning direction, the inkjet heads 41 vibrate as in steps S4, S5, or S8, S9 of FIGS. 5A and 5B, and thus printing is considered to be started after the vibration converges. This method however has a problem of a drop in productivity. On the other hand, when the inkjet heads 41 with the vibration or the residual vibration discharge ink drops from the nozzles 43, landing misalignment of ink drops occurs, which may cause deterioration in picture quality.

To solve these problems, the controller 6 performs print processing by selecting nozzles 43 to be used. The following will describe operations of performing print processing by selecting nozzles 43 to be used in detail.

Figure 8:
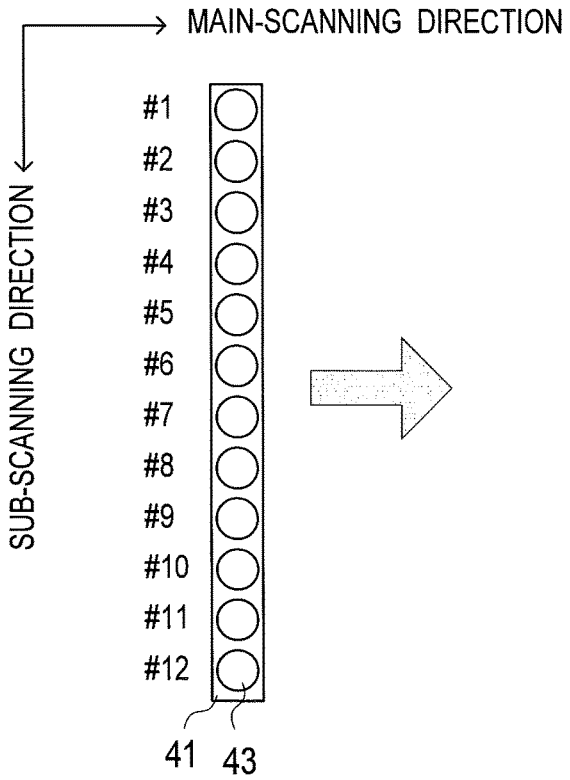
FIG. 8 is a diagram illustrating nozzles of an inkjet head shown in FIG. 2, which are viewed from the top of the inkjet head.
Figure 9:
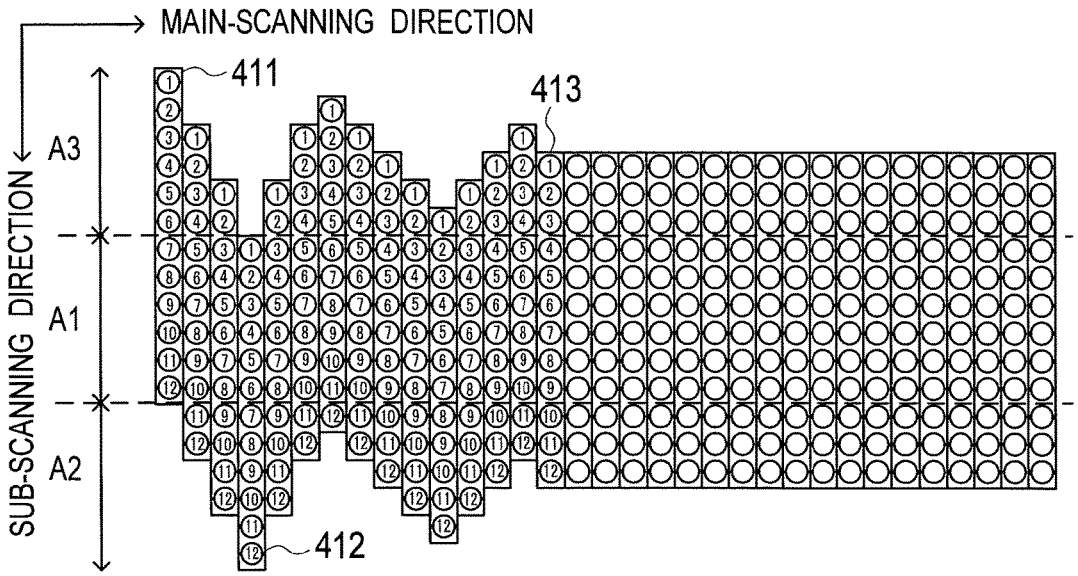
FIG. 9 is a diagram illustrating respective nozzle positions while an inkjet head shown in FIG. 2 moves in a main-scanning direction, which are viewed from the top of the inkjet head.
Figure 10A:
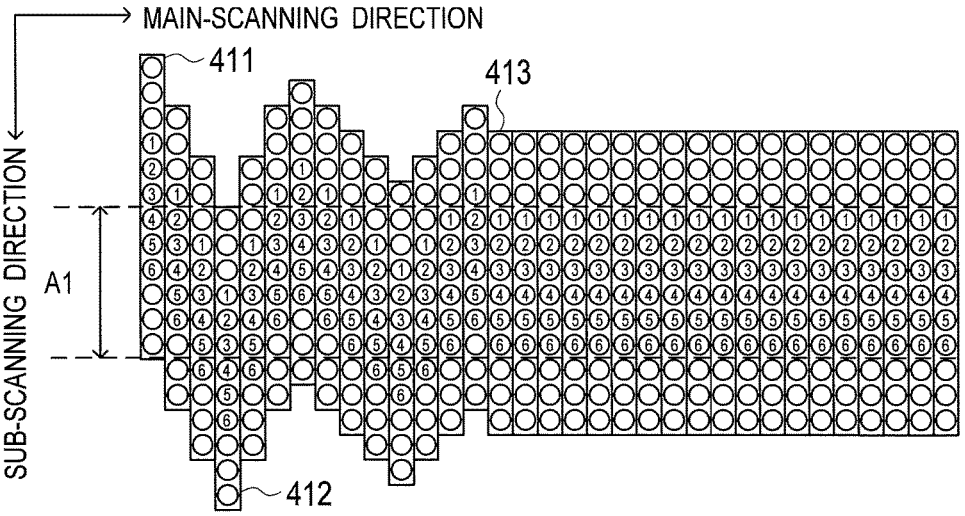
FIG. 10A is a selection diagram illustrating a positional relationship among use nozzles, which is viewed from the top of the inkjet head.
Figure 10B:
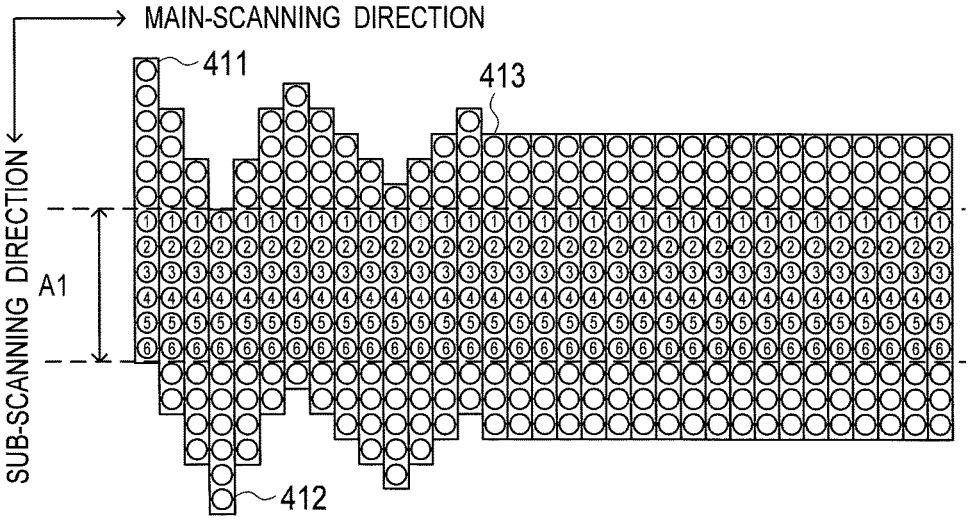
FIG. 10B is a selection diagram illustrating a positional relationship among changed use nozzles, which is viewed from the top of the inkjet head.
Figure 11A:
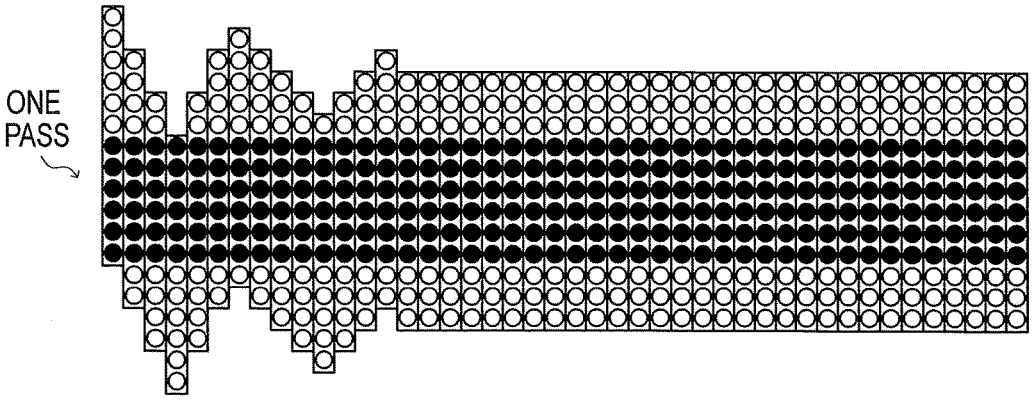
FIG. 11A is a diagram illustrating a dot pattern viewed from the top of the inkjet head when print processing is performed by selecting nozzles to be used.
Figure 11B:
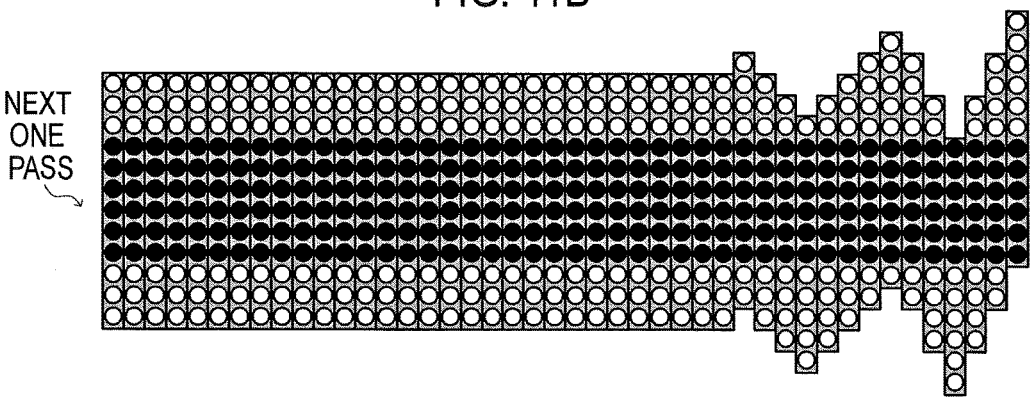
FIG. 11B is a diagram illustrating a dot pattern viewed from the top of the inkjet head when print processing is performed by selecting nozzles to be used.
Figure 11C:
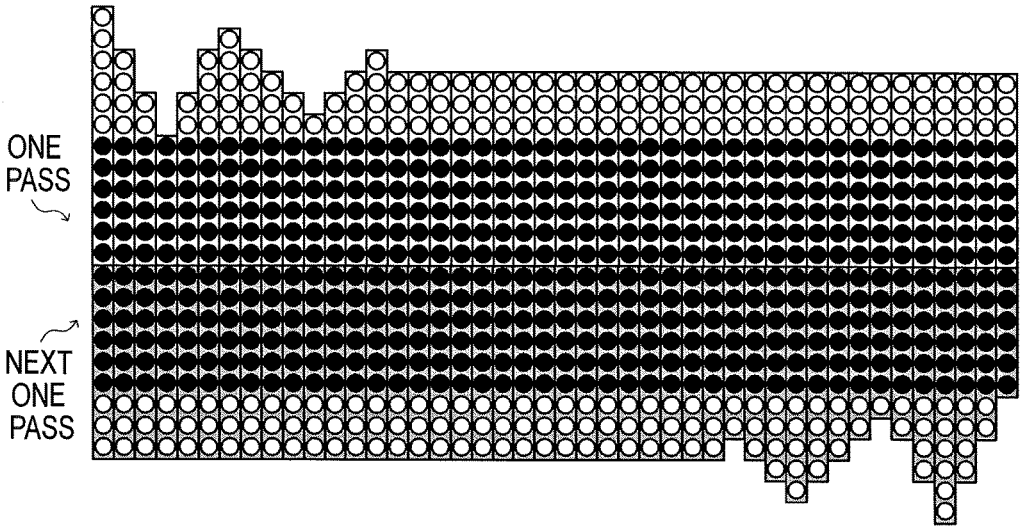
FIG. 11C is a diagram illustrating a dot pattern viewed from the top of the inkjet head when print processing is performed by selecting nozzles to be used.

FIG. 8 is a diagram illustrating nozzles 43 of the inkjet head 41, which are viewed from the top of the inkjet head 41. FIG. 9 is a diagram illustrating respective nozzle positions while the inkjet head 41 moves in the main-scanning direction, which are viewed from the top of the inkjet head 41. FIG. 10A is a selection diagram illustrating a positional relationship among use nozzles, which is viewed from the top of the inkjet head 41. FIG. 10B is a selection diagram illustrating a positional relationship among changed use nozzles, which is viewed from the top of the inkjet head 41. FIGS. 11A to 11C are diagrams, each illustrating a dot pattern viewed from the top of the inkjet head 41 when print processing is performed by selecting nozzles.

In FIGS. 8 to 11C, four inkjet heads 41 are indicated as one inkjet head 41 to simplify explanations. Moreover, in FIGS. 8 to 11C, the number of nozzles 43 of the inkjet head 41 is set as twelve and the number of rows of nozzles 43 included in the inkjet head 41 is indicated as one row. The actual number of nozzles 43 for each inkjet head 41 is not limited to twelve and may be about several hundreds to several thousands as necessary. The actual number of rows of nozzles 43 for each inkjet head 41 is not limited to one row and may be plural rows as necessary. In FIGS. 8 and 9, for twelve nozzles 43, the number 1 (or reference number #1), the number 2 (or reference number #2) . . . the number 12 (or reference number #12) are assigned from the front toward the back along the sub-scanning direction. In FIGS. 11A to 11C, nozzles 43 that discharge ink drops are shown as black dots and nozzles 43 that do not discharge ink drops are shown as white dots.

As shown in FIG. 8, the inkjet head 41 forms pixels on the printing medium 15 by discharging ink drops from each nozzle 43 while the inkjet head 41 moves along the main-scanning direction from left to right on FIG. 8. FIG. 8 shows a state in which the inkjet head 41 does not vibrate. In this case, while the inkjet head 41 moves along the main-scanning direction, each nozzle 43 moves parallel to the main-scanning direction and thus a locus of each nozzle 43 is drawn so that nozzles 43 to which the same reference number is assigned are always arranged on a straight line along the main-scanning direction.

On the other hand, as shown in FIG. 9, when the inkjet head 41 vibrates, a position of each nozzle 43 in the main-scanning direction fluctuates while the inkjet head 41 moves along the main-scanning direction. When all of the nozzles 43 discharge ink drops, there are formed regions in which pixels are not formed on straight lines extending in the main-scanning direction on the printing medium 15 (regions A2 and A3 in FIG. 9). To deal with this problem, before starting printing, the controller 6 moves the inkjet head 41 in the sub-scanning direction and controls the displacement detecting sensors 71A and 71B to detect the maximum amplitude of the vibration in the sub-scanning direction. In accordance with the maximum amplitude of the vibration, the controller 6 determines the amount of driving by the sub-scanning driving motor 12 and the number of nozzles 43 to be used. In FIGS. 9, 10A, 10B, and 13, reference numbers 411, 412, 413, 414, 415, 416, and 417 indicate the inkjet head 41 at respective positions when the controller 6 moves the inkjet head 41 in the main-scanning direction.

In particular, the controller 6 determines a region A1, which is an overlapped region of: the inkjet head 411 with the maximum amplitude toward the front direction along the sub-scanning direction; and the inkjet head 412 with the maximum amplitude toward the back direction along the sub-scanning direction, as the amount of driving by the sub-scanning driving motor 12. The controller 6 then uses nozzles 43 within the region A1, for example, in FIG. 9, the fourth nozzle 43 to the ninth nozzle 43 of the inkjet head 413 where the inkjet head 41 stops vibrating. This enables the inkjet head 41 to form all the pixels on each straight line extending in the main-scanning direction within the region A1 on the printing medium 15 even when the inkjet head 41 vibrates.

In this way, the number of nozzles 43 to be used is changed in accordance with the maximum amplitude of the vibration in the front direction along the sub-scanning direction and the maximum amplitude of the vibration in the back direction along the sub-scanning direction. However, as shown in FIG. 10A, when the inkjet head 41 vibrates, positions of dots formed by ink drops discharged from respective nozzles 43 are displaced as the inkjet head 41 moves in the main-scanning direction. In particular, when the fourth nozzle 43 to the ninth nozzle 43 of the inkjet head 41 are fixed as use nozzles 1 to 6 in an example shown in FIG. 10A, the inkjet head 411 is displaced by three nozzles in the front direction and the inkjet head 411 performs printing over the region A1, which is to be printed, by three dots in the front direction. In the same way, the inkjet head 412 is displaced by three nozzles in the back direction and the inkjet head 412 performs printing over the region A1, which is to be printed, by three dots in the back direction.

To deal with this problem, the controller 6 performs printing by selecting nozzles 43 to be used in accordance with displacement of the inkjet head 41 in the sub-scanning direction, which is detected by the displacement detecting sensors 71A and 71B, while moving the inkjet head 41 in the main-scanning direction.

In particular, the controller 6 changes nozzles 43 to be used by the number of nozzles that are displaced in the main-scanning direction due to the vibration of the inkjet head 41 so that nozzles 43 to be used fit within the region A1 to be printed. For example, as the inkjet head 411 shown in FIG. 10B is displaced by 3 nozzles in the front direction, the controller 6 shifts the nozzles 43 to be used by 3 nozzles in the back direction (the seventh nozzle 43 to the twelfth nozzle 43 of the inkjet head 43 in FIG. 9, use nozzles 1 to 6 of the inkjet head 411 in FIG. 10B). Further, as the inkjet head 412 shown in FIG. 10B is displaced by 3 nozzles in the back direction, the controller 6 shifts the nozzles 43 to be used by 3 nozzles in the front direction (the first nozzle 43 to the sixth nozzle 43 of the inkjet head 412 in FIG. 9, use nozzles 1 to 6 of the inkjet head 412 in FIG. 10B).

In this way, regarding the inkjet head 41 that has nozzles 43 displaced in the sub-scanning direction, the controller 6 changes the nozzles 43 to be used. As shown in FIG. 10B, this achieves printing by the use nozzles 1 to 6 within the region A1 to be printed.

As shown in FIGS. 11A and 11B, the print processing with the control by the controller 6 forms images without ink misalignment both for the first pass and the second pass. As shown in FIG. 11C, by moving the inkjet head 41 to connect the images, an image that absorbs the ink misalignment due to the vibration is formed on the printing medium 15.

(Operations of Inkjet Printing Machine)

Figure 12:
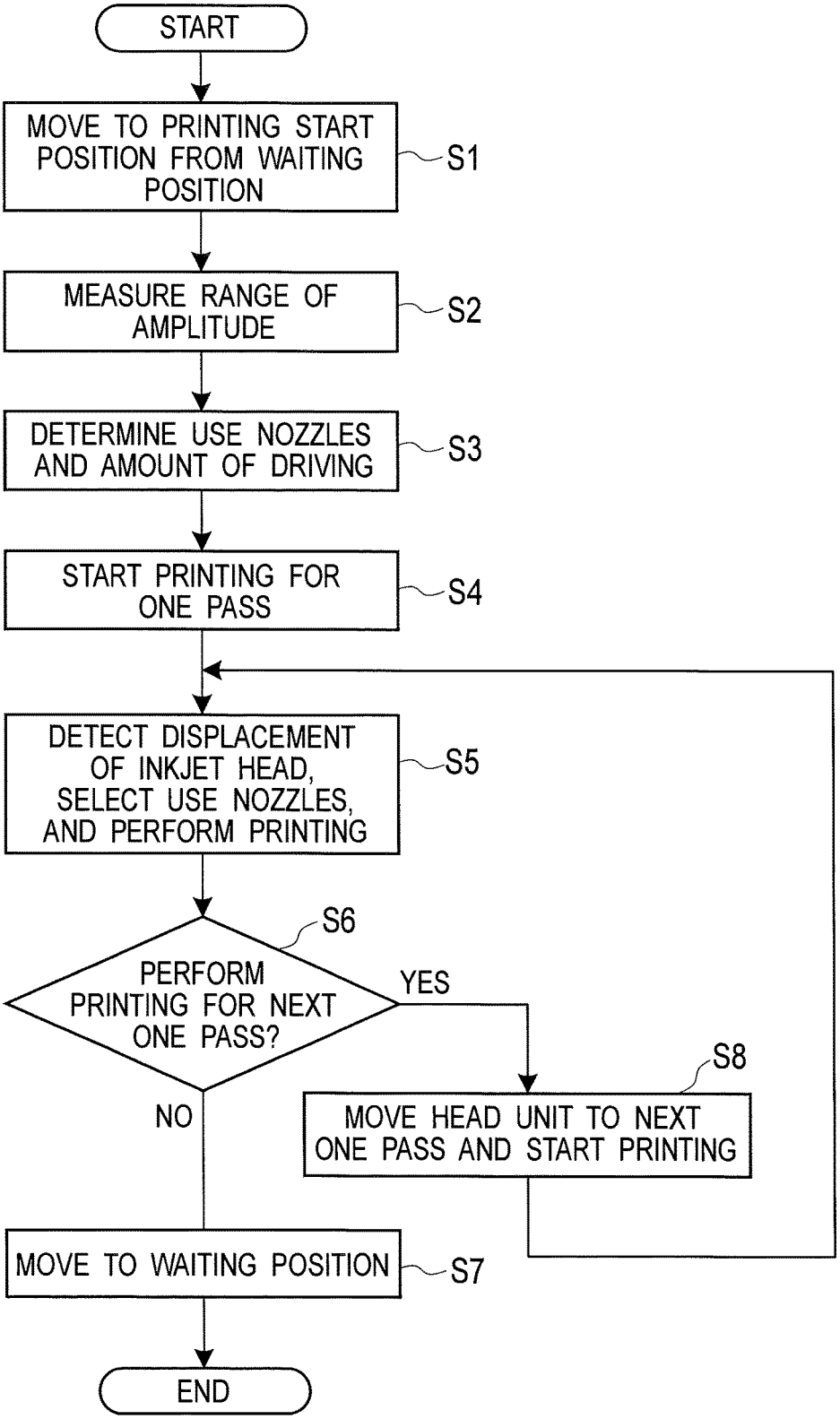
FIG. 12 is a flowchart illustrating operations of the inkjet printing machine shown in FIG. 1.

Next, operations of the inkjet printing machine 1 having the above-described configuration will be described. FIG. 12 is a flowchart illustrating operations of the inkjet printing machine 1. The processing shown in the flowchart of FIG. 12 is started when a print job is input into the inkjet printing machine 1 from an outside personal computer. Before starting the processing shown in the flowchart of FIG. 12, the printing medium 15 is set on the medium placement surface 3*a* of the flatbed unit 3.

In step S1, before starting printing, the controller 6 controls the sub-scanning driving motor 12 to move the inkjet head 41 in the sub-scanning direction to a printing start position. In step S2, the controller 6 detects the maximum amplitude of the vibration in the front direction and the maximum amplitude of the vibration in the back direction along the sub-scanning direction using the displacement detecting sensors 71A and 71B. In step S3, the controller 6 determines the amount of driving by the sub-scanning driving motor 12 and the number of nozzles 43 to be used in accordance with the detected maximum amplitudes.

In step S4, the controller 6 starts print processing for the first pass. In step S5, the controller 6 obtains displacement of the inkjet head 41 in the sub-scanning direction at each position of the inkjet head 41 along the main-scanning direction, which is detected by the displacement detecting sensors 71A and 71B, while the inkjet head 41 moves in the main-scanning direction at a current pass. The controller 6 then selects nozzles 43 to be used in accordance with the detected displacement and performs print processing.

In step S6, the controller 6 determines whether or not to perform printing for the next pass. When printing is not performed (step S6: NO), the controller 6 performs processing in step S7. In step S7, the controller 6 controls the sub-scanning driving motor 12 to move the inkjet head 41 in the sub-scanning direction to a waiting position, and printing is ended. On the other hand, when printing is performed (step S6: YES), the controller 6 performs processing in step S8. In step S8, the controller 6 controls the sub-scanning driving motor 12 to relatively move the inkjet head 41 and the printing medium 15 in the sub-scanning direction and starts print processing for the next pass.

(Operation and Effect)

As described above, in the inkjet head printing machine 1, before starting printing, the controller 6 moves the inkjet head 41 in the sub-scanning direction and controls the displacement detecting sensors 71A and 71B to detect the maximum amplitude of the vibration in the sub-scanning direction. In accordance with the detected maximum amplitude, the controller 6 determines the amount of driving by the sub-scanning driving motor 12 and the number of nozzles 43 to be used, and determines a printing pitch for one pass in the sub-scanning direction. The controller 6 then performs printing by alternatively repeating: an operation A of discharging ink drops from nozzles 43 on the printing medium 15 while controlling the main-scanning driving unit 22 to move the inkjet head 41 in the main-scanning direction; and an operation B of moving the inkjet head 41 in the sub-scanning direction by the printing pitch.

In the operation A, the controller 6 performs printing by selecting nozzles 43 to be used in accordance with the displacement of the inkjet head 41 in the sub-scanning direction, which is detected by the displacement detecting sensors 71A and 71B while the inkjet head 41 is moved in the main-scanning direction. This enables a region of use nozzles, which is to be formed by selected nozzles 43 for the printing pitch, to be moved following the displacement due to the vibration occurring when the inkjet head 41 relatively moves in the sub-scanning direction. As shown in FIGS. 11A to 11C, it is therefore possible to absorb landing misalignment of ink drops due to the vibration of the inkjet head 41. As a result, the productivity is improved without causing degradation in the printing quality.

Second Embodiment

Figure 13A:
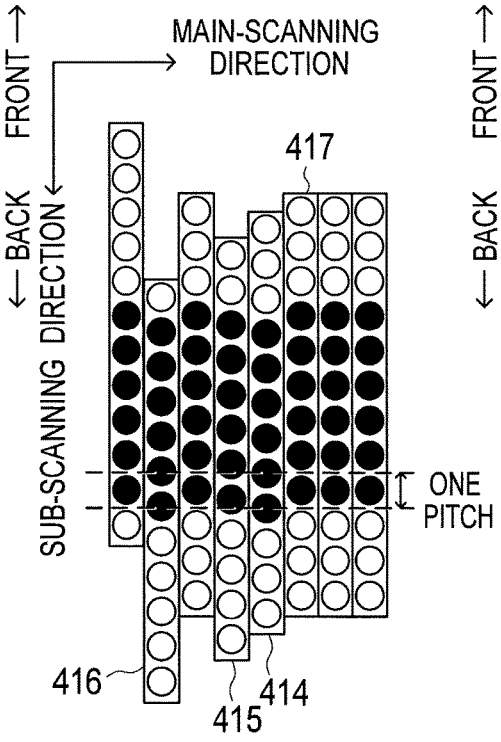
FIG. 13A is a diagram illustrating dots formed by ink drops discharged from use nozzles according to the first embodiment, which are viewed from the top of the inkjet head.
Figure 13B:
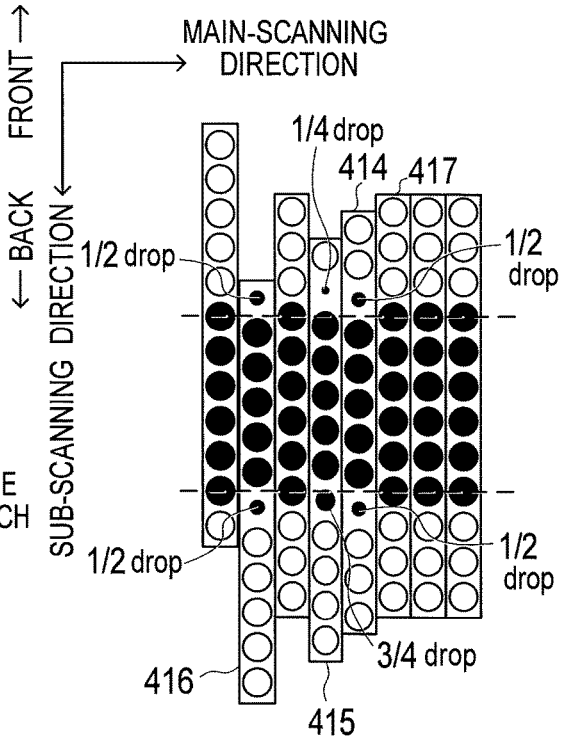
FIG. 13B is a diagram illustrating dots formed by ink drops discharged from use nozzles according to a second embodiment, which are viewed from the top of the inkjet head.

Next, a second embodiment according to the present invention will be described. The present embodiment relates to a control in a case in which a nozzle pitch is displaced due to amplitude. FIG. 13A is a diagram illustrating dots/printing pattern formed by ink drops discharged from use nozzles according to the first embodiment, which are viewed from the top of the inkjet head 41. FIG. 13B is a diagram illustrating dots/printing pattern formed by ink drops discharged from use nozzles according to a second embodiment, which are viewed from the top of the inkjet head 41.

When the inkjet head 41 vibrates in the sub-scanning direction, a nozzle pitch in the main-scanning direction is not always formed steady as shown in FIGS. 7A to 10B. There is a case in which dots are not aligned on the nozzle pitch. In an example shown in FIG. 13A, a dot pattern formed by ink drops discharged from respective use nozzles of the inkjet head 414 is displaced by one-half dot with respect to a dot pattern formed by ink drops discharged from respective use nozzles of the inkjet head 417 that is the inkjet head 41 at a point of time when the inkjet head 41 stops vibration. A dot pattern formed by ink drops discharged from respective use nozzles of the inkjet head 415 is displaced by one-fourth of a dot with respect to a dot pattern formed by ink drops discharged from respective use nozzles of the inkjet head 417. A dot pattern formed by ink drops discharged from respective use nozzles of the inkjet head 416 is displaced by one-half dot from a dot pattern formed by ink drops discharged from respective use nozzles of the inkjet head 417.

In such cases, nozzles 43 to be used are selected in accordance with the displacement of the inkjet head 41 in the sub-scanning direction, which is detected by the displacement detecting sensors 71A and 71B, and the printing is performed. As shown in FIG. 13A, if the use nozzle 1 and the use nozzle 6, which are positioned on both ends of the region of use nozzles formed by selected use nozzles 1 to 6 (refer to FIG. 10B), discharge a normal droplet quantity, misalignment in the image occurs in the part of the use nozzles 1 and 6, which causes degradation in the printing quality.

To deal with this problem, in the present embodiment, when the inkjet head 41 is displaced in the back direction in the sub-scanning direction, in accordance with the amount of displacement in the back direction in the sub-scanning direction, the controller 6 determines whether or not dots formed by ink drops discharged from nozzles 43 of the inkjet head 41 are on the nozzle pitch of nozzles 43 of the inkjet head 41 that does not vibrate. When the dots are not on the nozzle pitch, the controller 6 adds a nozzle 43 that is adjacent to the use nozzle 1 of the inkjet head 41 in the front direction in the sub-scanning direction as a use nozzle 0. The controller 6 then changes the quantity of an ink drop discharged from the use nozzle 0. The controller 6 also changes the quantity of an ink drop discharged from the use nozzle 6.

On the other hand, when the inkjet head 41 is displaced in the front direction in the sub-scanning direction, in accordance with the amount of displacement in the front direction in the sub-scanning direction of the inkjet head 41, the controller 6 determines whether or not dots formed by ink drops discharged from nozzles 43 of the inkjet head 41 are on the nozzle pitch of nozzles 43 of the inkjet head 41 that does not vibrate. When the dots are not on the nozzle pitch, the controller 6 adds a nozzle 43 that is adjacent to the use nozzle 6 in the back direction in the sub-scanning direction as a use nozzle 7. The controller 6 then changes the quantity of an ink drop discharged from the use nozzle 7. The controller 6 also changes the quantity of an ink drop discharged from the use nozzle 1 of the inkjet head 41.

In this way, the controller 6 determines whether or not the displacement in the sub-scanning direction, which is detected by the displacement detecting sensors 71A and 71B, is a displacement in which dots are not on the nozzle pitch. When there is the displacement, the controller 6 calculates a ratio of the amount of displacement. Among the use nozzles 1 to 6 (see FIG. 10B), the controller 6 reduces the quantity of an ink drop discharged from the use nozzle 1 (or 6) and the quantity of an ink drop discharged from a nozzle 43 (use nozzle 7 or 0) adjacent to the use nozzle 6 (or 1). The quantity of a drop is adjusted by a multi drop method.

In an example shown in FIG. 13B, a dot pattern formed by ink drops discharged from respective use nozzles of the inkjet head 414 or that of the inkjet head 416 is displaced by one-half dot in the sub-scanning direction with respect to a dot pattern formed by ink drops discharged from respective use nozzles of the inkjet head 417. The controller 6 suppresses the quantity of an ink drop to be discharged from the nozzle 43 (use nozzle 0) adjacent to the use nozzle 1 and that to be discharged from the use nozzle 6 to form a dot having the size of one-half dot.

A dot pattern formed by ink drops to be discharged from respective use nozzles of the inkjet head 415 is displaced by one-fourth dot in the back direction in the sub-scanning direction with respect to a dot pattern formed by ink drops to be discharged from respective use nozzles of the inkjet head 417. The controller 6 suppresses the quantity of an ink drop discharged from the use nozzle 6 to form a dot having the size of three-fourth dot, and suppresses the quantity of an ink drop discharged from the nozzle 43 (use nozzle 0) adjacent to the use nozzle 1 to form a dot having the size of one-fourth dot.

According to the present embodiment, in accordance with displacement and a direction of the inkjet head 41 in the sub-scanning direction due to the vibration, among the use nozzles 1 to 6 (see FIG. 10B), the controller 6 changes the quantity of an ink drop to be discharged from the use nozzle 1 (or 6) and that to be discharged from the nozzle 43 (use nozzle 7 or 0) adjacent to the use nozzle 6 (or 1). At each inkjet head 41, it is therefore possible to deal with the displacement smaller than the diameter of the nozzle 43, which cannot be solved only by selecting nozzles to be used, by changing the size of an ink drop to be discharged from the use nozzle 1 (or 6) and that to be discharged from the nozzle 43 (use nozzle 7 or 0) adjacent to the use nozzle 6 (or 1) among the use nozzles 1 to 6 (refer to FIG. 10B), in accordance with the displacement and the direction of the inkjet head 41 in the sub-scanning direction due to the vibration. As a result, the degradation in the printing quality is further reduced.

The present invention is not limited to the above embodiments and the structural components can be realized by modifying them without departing from the gist at the implementation stage. Moreover, various inventions can be constituted by appropriately combining the various structural components disclosed in the above embodiment. For example, some of the structural components among all the structural components described in the embodiments can be omitted.

For example, the above-described embodiments exemplify a case with four inkjet heads, but the present invention is not limited to this. The number of inkjet heads may be less or more than four. Moreover, in the present embodiment, the controller 6 sets the region A1, which is an overlapped region of: the inkjet head 411 with the maximum amplitude toward the front direction in the sub-scanning direction; and the inkjet head 412 with the maximum amplitude toward the back direction in the sub-scanning direction, as the amount of driving by the sub-scanning driving motor 12, and the present embodiment exemplifies a case in which nozzles 43 within the region A1 are used. The present invention is however not limited to this. For example, a region smaller than the region A1 in which the inkjet head 411 with the maximum amplitude in the front direction in the sub-scanning direction and the inkjet head 412 with the maximum amplitude in the back direction in the sub-scanning direction overlap each other may be set as the amount of driving by the sub-scanning driving motor 12, and nozzles 43 within the region smaller than the region A1 may be used.

What is claimed is:

1. An inkjet printing machine comprising:

an inkjet head that includes a plurality of nozzles arranged along a sub-scanning direction;

a main-scanning driver that moves the inkjet head in a main-scanning direction orthogonal to the sub-scanning direction;

a sub-scanning driver that relatively moves the inkjet head and a printing medium in the sub-scanning direction;

a displacement detector that detects displacement of the inkjet head in the sub-scanning direction; and a controller that performs a control for printing an image on the printing medium by alternately repeating an operation of discharging ink drops on the printing medium from the nozzles while causing the main-scanning driver to move the inkjet head in the main-scanning direction, and an operation of causing the sub-scanning driver to relatively move the inkjet head and the printing medium in the sub-scanning direction, wherein the controller determines the amount of driving by the sub-scanning driver and the number of nozzles to be used among the nozzles in accordance with a maximum amplitude of vibration of the inkjet head in the sub-scanning direction, the maximum amplitude being detected by the displacement detector when the inkjet head is moved in the sub-scanning direction before starting printing, and performs printing by selecting at least one nozzle to be used in accordance with displacement of the inkjet head in the sub-scanning direction, the displacement being detected by the displacement detector while the inkjet head is moved in the main-scanning direction.

2. The inkjet printing machine according to claim 1, wherein the controller changes the quantity of an ink drop discharged from a nozzle that is positioned at an end of the selected at least one nozzle to be used in accordance with displacement of the inkjet head in the sub-scanning direction detected by the displacement detector.

* * * * *